US010807142B2

(12) United States Patent
Asano

(10) Patent No.: US 10,807,142 B2
(45) Date of Patent: Oct. 20, 2020

(54) HOT BLOW FORMING METHOD FOR ALUMINUM ALLOY SHEET

(71) Applicant: UACJ Corporation, Tokyo (JP)

(72) Inventor: Mineo Asano, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 427 days.

(21) Appl. No.: 15/528,941

(22) PCT Filed: Apr. 21, 2015

(86) PCT No.: PCT/JP2015/062104
§ 371 (c)(1),
(2) Date: May 23, 2017

(87) PCT Pub. No.: WO2016/084402
PCT Pub. Date: Jun. 2, 2016

(65) Prior Publication Data

US 2017/0341123 A1 Nov. 30, 2017

Related U.S. Application Data

(60) Provisional application No. 62/083,627, filed on Nov. 24, 2014.

(51) Int. Cl.
*B21D 26/021* (2011.01)
*B21D 26/02* (2011.01)
(Continued)

(52) U.S. Cl.
CPC ..... *B21D 26/021* (2013.01); *B21D 26/02* (2013.01); *C21D 11/00* (2013.01); *C22C 21/02* (2013.01); *C22C 21/08* (2013.01)

(58) Field of Classification Search
CPC ..... B21D 26/021; B21D 26/027; B21D 26/00
(Continued)

(56) References Cited

U.S. PATENT DOCUMENTS 4,352,280 A * 10/1982 Ghosh ..... B21D 26/059 72/364
5,085,068 A * 2/1992 Rhoades ..... B21D 26/02 72/54
(Continued)

FOREIGN PATENT DOCUMENTS

DE 2939002 A1 * 4/1981
DE 102008014103 A1 9/2009
(Continued)

OTHER PUBLICATIONS

Joint publication of ASTM International and SAE International. (2008). Metals and Alloys in the Unified Numbering System (11th Edition). (pp. 48). ASTM International.Retrieved from https://app.knovel.com/hotlink/toc/id:kpMAUNSE01/metals-alloys-in-unified/metals-alloys-in-unified (Year: 2008).*
(Continued)

*Primary Examiner* — Teresa M Ekiert
*Assistant Examiner* — Sarkis A Aktavoukian
(74) *Attorney, Agent, or Firm* — David D. Brush; Westman, Champlin & Koehler, P.A.

(57) ABSTRACT

A hot blow forming method for the aluminum alloy sheet carries out a hot blow forming to an aluminum alloy sheet using a first metal mold being a female mold for forming having a protruding surface portion on an inside surface thereof and a second metal mold for gas introduction. Immediately prior to the hot blow forming, a temperature (T1) of the aluminum alloy sheet and a temperature (T2) of the first metal mold satisfy a relation (T1)-(T2)≥30° C. and the temperature (T2) is equal to or higher than 400° C. In the hot blow forming, the aluminum alloy sheet is made to be brought into contact with at least a part of the protruding surface portion of the first metal mold within 30 seconds
(Continued)

from a start of the gas introduction from the second metal mold.

4 Claims, 11 Drawing Sheets

(51) Int. Cl.
*C21D 11/00* (2006.01)
*C22C 21/02* (2006.01)
*C22C 21/08* (2006.01)

(58) Field of Classification Search
USPC ..... 72/38
See application file for complete search history.

(56) References Cited

U.S. PATENT DOCUMENTS 5,591,369 A * 1/1997 Matsen ..... B21D 26/021 219/633
5,645,744 A * 7/1997 Matsen ..... B21D 26/021 219/634
5,649,438 A * 7/1997 Hall, Jr. ..... B21D 26/02 72/60
5,749,254 A * 5/1998 Hall, Jr. ..... B21D 22/12 29/421.1
5,914,064 A * 6/1999 Gillespie ..... B21D 26/021 219/615
6,087,640 A * 7/2000 Gillespie ..... B21D 26/021 219/615
7,049,548 B1 * 5/2006 Sjogren ..... B21D 26/021 219/385
7,112,249 B2 * 9/2006 Schroth ..... B21D 26/021 148/511
9,511,404 B1 * 12/2016 Huang ..... B21D 26/029
2004/0074273 A1 * 4/2004 Kim ..... B21D 26/021 72/57
2004/0083784 A1 * 5/2004 Kim ..... B21D 26/021 72/57
2005/0067063 A1 * 3/2005 Schroth ..... B21D 26/021 148/511
2005/0126242 A1 * 6/2005 Kruger ..... B21D 26/021 72/57
2005/0150265 A1 * 7/2005 Kim ..... B21D 26/021 72/60
2008/0079201 A1 * 4/2008 Durney ..... B21D 26/021 264/570
2008/0127697 A1 * 6/2008 Luckey ..... B21D 26/021 72/57
2008/0264131 A1 * 10/2008 Luckey ..... B21D 26/021 72/57
2009/0272171 A1 * 11/2009 Golovashchenko ... B21D 22/24 72/348
2010/0192655 A1 * 8/2010 Carter ..... B08B 7/0014 72/40
2010/0307215 A1 * 12/2010 Morales ..... B21D 26/021 72/342.7
2011/0239721 A1 * 10/2011 Carter ..... B21D 26/021 72/60
2013/0160511 A1 * 6/2013 Huang ..... B21D 26/021 72/60
2013/0240609 A1 * 9/2013 Sanders ..... B21D 26/021 228/114
2013/0276499 A1 * 10/2013 Shulkin ..... B21D 26/055 72/60
2015/0102128 A1 * 4/2015 Douglas ..... B21D 26/021 239/265.19
2015/0143861 A1 * 5/2015 Sato ..... B21D 22/208 72/17.3
2017/0087617 A1 * 3/2017 Prasannavenkatesan ..... B21D 26/031
2017/0106625 A1 * 4/2017 Sachdev ..... B32B 7/05
2017/0182537 A1 * 6/2017 Kim ..... B21D 22/022
2017/0182540 A1 * 6/2017 Bryant ..... B21D 26/021

FOREIGN PATENT DOCUMENTS

EP 2907597 A1 * 8/2015 ..... B21D 26/021
JP H04167931 A 6/1992
JP 2008-062255 A 3/2008
JP 2008062255 A * 3/2008 ..... B21D 26/021
JP 2012-076138 A 4/2012
JP 2012076138 A * 4/2012
WO 2013/171884 A1 11/2013

OTHER PUBLICATIONS

Davis, J.R.. (1998). Metals Handbook, Desk Edition (2nd Edition). (pp. 460-461). ASM International. Retrieved from https://app.knovel.com/hotlink/toc/id:kpMHDEE004/metals-handbook-desk/metals-handbook-desk (Year: 1998).*
International Search Report with English Translation dated Jul. 15, 2015 for International Application No. PCT/JP2015/062104 filed Apr. 21, 2015, 6 pages.
Written Opinion of the International Search Authority dated Jul. 15, 2015 for International Application No. PCT/JP2015/062104 filed Apr. 21, 2015, 3 pages.
Canadian Office Action dated Nov. 6, 2018 for corresponding Canadian patent application No. 2,968,802.
English translation of the International Preliminary Report on Patentability and Written Opinion of the International Search Authority dated Apr. 21, 2015 for International Application No. PCT/JP2015/062104 filed Apr. 21, 2015, (IB/338, IB/373, ISA/237).
Canadian Office Action dated Apr. 23, 2018 in the corresponding Canadian patent application No. 2,968,802.
European Search Report dated Apr. 25, 2018 in the corresponding European patent application No. 15863475.8.
Qiao J. et al., "Superplasticity-like creep behavior of coarse grained ternary A1 alloys" Transactions of Nonferrous Metals Society of China: English Edition = Shongguo-Youse-Jinshu-Xuebao, Elsevier, Amsterdam, NL, vol. 20, No. 4, Apr. 1, 2010 (Apr. 1, 2010), pp. 564-571, XP027045411.
H. Iwasaki et al., "Cavitation Behavior of Coarse-Grained A1-4.5Mg Alloy Exhibiting Superplastic-Like Elongation", MRS Proceedings, vol. 601, Jan. 1, 1999 (Jan. 1, 1999), XP055465729.
Ito Tsutomu et al., "Ductility of 6XXX aluminum alloys at high temperature", Keikinzoku—Journal of the Japan Institute of Light Metals, Meikinzoku Gakkai, JP, vol. 53, No. 3, Jan. 1, 2003 (Jan. 1, 2003), pp. 114-120, XP009504639. English translation of relevant parts.
European Office Action dated Apr. 3, 2020 in the corresponding European Patent Application No. 15863475.8.

* cited by examiner

HOT BLOW FORMING METHOD FOR ALUMINUM ALLOY SHEET

CROSS-REFERENCE TO RELATED APPLICATIONS

This Application is a Section 371 National Stage Application of International Application No. PCT/JP2015/062104, filed Apr. 21, 2015, published as WO 2016/084402 A1, on Jun. 2, 2016, which claims the benefit of U.S. Provisional Patent Application No. 62/083,627 filed on Nov. 24, 2014 with the U.S. Patent Office, the entire contents of which are incorporated herein by reference.

TECHNICAL FIELD

The present disclosure relates to a hot blow forming method for an aluminum alloy sheet.

BACKGROUND ART

An aluminum alloy sheet is used, for example, for a component of a transportation, such as an airplane, a railway, an automobile, and so on, for a component of a home electric appliance, such as a digital camera, a personal computer, lighting equipment, and so on, and for other various components. A press forming method has been used, for example, as a method of forming an aluminum alloy sheet to a predetermined shape.

The press forming method is not appropriate to integrally form an aluminum alloy sheet to a complicated shape. Therefore, conventionally, in order to obtain a complicatedly-shaped formed product, the formed product was divided into multipleparts, the multiple parts were respectively manufactured into press-formed products, and these press-formed products were welded to be integrated. However, this method increases the frequency to repair the weldings, which leads to reduced productivity.

In order to solve the above problem, a hot blow forming method has been developed. The hot blow forming method is a method of spraying a high pressure gas onto an aluminum alloy sheet under high temperature environment and pressing the aluminum alloy sheet to an inside surface (forming surface) of a female mold for forming. For example, Patent Document 1 discloses a hot blow forming method for an aluminum alloy sheet.

PRIOR ART DOCUMENTS

Patent Documents

Patent Document 1: Japanese Unexamined Patent Application Publication No. 2008-62255

SUMMARY OF THE INVENTION

Problems to be Solved by the Invention

However, Patent Document 1 discloses only a hot blow forming method by which an aluminum alloy sheet is expanded simply radially for integral forming. For example, when an aluminum alloy sheet is integrally formed into a complicated shape, especially into a shape having a deep recessed surface portion, the following problem may occur.

That is, when an aluminum alloy sheet is formed to a shape having a deep recessed surface portion, a protruding surface portion is provided at an inside surface of a female mold for forming, the protruding surface portion which has a shape corresponding to the recessed surface portion. When a hot blow forming is carried out for an aluminum alloy sheet by use of such female mold for forming, stress concentration occurs at the aluminum alloy sheet during the forming at the protruding surface portion of the inside surface of the female mold for forming (especially around the top). Cracking therefore easily occurs at the aluminum alloy sheet.

According to an aspect of the present invention, it is preferable to provide a hot blow forming method for an aluminum alloy sheet, which inhibits cracking of the aluminum alloy sheet at the time of hot blowing forming and makes it easier to integrally form the aluminum alloy sheet to a complicated shape.

Means for Solving the Problems

In a hot blow forming method for the aluminum alloy sheet according to an aspect of the present invention, hot blow forming for the aluminum alloy sheet is carried out using a first metal mold, which is a female mold for forming having a protruding surface portion on an inside surface thereof, and a second metal mold for gas introduction, immediately prior to the hot blow forming, a temperature (T1) of the aluminum alloy sheet and a temperature (T2) of the first metal mold satisfy a relation (T1)-(T2)≥30° C., the temperature (T2) is equal to or more than 400° C.; and, in the hot blow forming, the aluminum alloy sheet is made to be brought into contact with at least a part of the protruding surface portion of the first metal mold within 30 seconds from a start of gas introduction from the second metal mold.

According to the hot blow forming method for the aluminum alloy sheet, it is possible to make a deformation resistance of a portion of the aluminum alloy sheet in contact with the protruding surface of the inside surface of the first metal mold higher than a deformation resistance of a portion of the aluminum alloy sheet not in contact with the inside surface of the first metal mold during the hot blow forming. Therefore, cracking of the aluminum alloy sheet, which easily occurs at the protruding surface portion at the inside surface of the first metal mold being the female mold for forming, is inhibited at the time of hot blow forming. As a result, it makes it easier to integrally form an aluminum alloy sheet to a complicated shape having such as an especially deep recessed surface portion.

EXPLANATION OF REFERENCE NUMERALS

Figure 1:
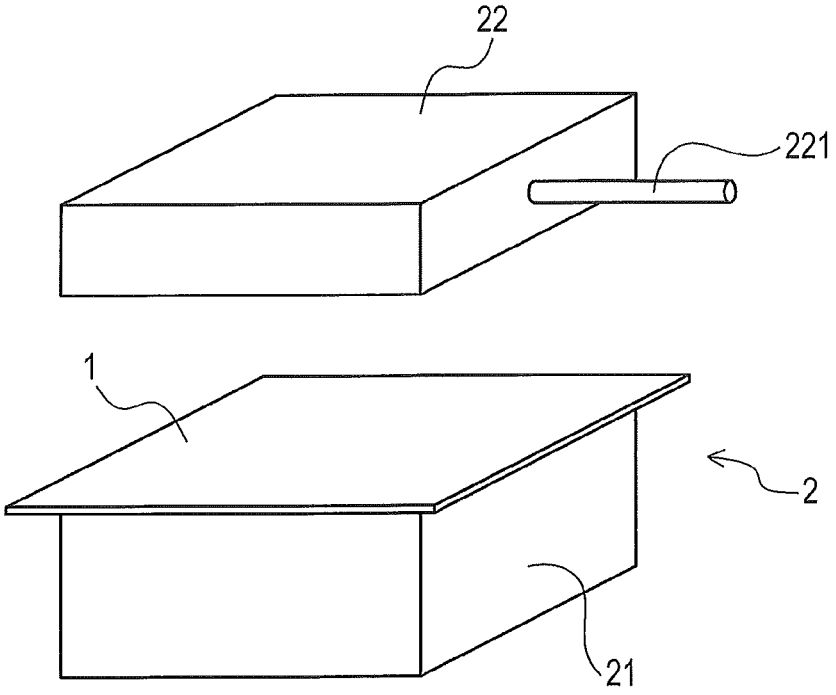
FIG. 1 is a perspective view illustrating an aluminum alloy sheet and a mold.

1 . . . aluminum alloy sheet, 21 . . . first metal mold, 210 . . . inside surface (inside surface of the first metal mold), 211 . . . protruding surface portion, 22 . . . second metal mold

MODE FOR CARRYING OUT THE INVENTION

The embodiments of the present invention will be described below. It is apparent that the present invention is not limited to the illustrative embodiments set forth herein and various modifications may be applicable without departing from the scope and spirit of the invention.

In the hot blow forming method for the aluminum alloy sheet, a hot blow forming is carried out to an aluminum alloy sheet by use of a first metal mold, which is a female mold for forming having a protruding surface portion on an inside surface, and a second metal mold for gas introduction.

The first metal mold is a recessed female mold for female forming an aluminum alloy sheet. The inside surface of the first metal mold is a forming surface which forms the aluminum alloy sheet to a predetermined shape. The protruding surface portion is provided at the inside surface of the first metal mold. The protruding surface portion may be configured with, for example, a curved surface (R surface and so on), multiple flat surfaces, or a combination thereof.

The second metal mold is a mold for gas introduction for introducing a high pressure gas for blow forming. It is good that the distance between the second metal mold and the aluminum alloy sheet at a time of hot blow forming is as close as possible in terms that a temperature ((T3) described later) of the second metal mold is made the same as or approximate to a temperature (T1) of the aluminum alloy sheet. For example, it is preferable that the distance between the gas introduction surface of the second metal mold and the aluminum alloy sheet is equal to or lower than 50 mm.

In the hot blow forming, forming is carried out by spraying a high pressure gas to the aluminum alloy sheet and pressing the aluminum alloy sheet to the inside surface (forming surface) of the first metal mold being the female mold for forming. In order that the reaction between the high pressure gas and the aluminum alloy sheet does not occur, for example, an inert gas, such as nitrogen gas and so on, is preferably used as the high pressure gas for blow forming.

According to the hot blow forming method for the aluminum alloy sheet, immediately prior to the hot blow forming, the temperature (T1) of the aluminum alloy sheet and the temperature (T2) of the first metal mold satisfy a relation (T1)-(T2)≥30° C., and the temperature (T2) is equal to or more than 400° C.

In order to inhibit cracking of the aluminum alloy sheet, which easily occurs at the protruding surface portion of the inside surface of the first metal mold being the female mold for forming, at the time of hot blow forming, it is necessary to set, during the hot blow forming, a deformation resistance of a portion of the aluminum alloy sheet in contact with the protruding surface of the inside surface of the first metal mold higher than a deformation resistance of a portion of the aluminum alloy sheet not in contact with the inside surface of the first metal mold. Accordingly, it is necessary that the temperature (T1) of the aluminum alloy sheet and the temperature (T2) of the first metal mold immediately prior to the hot blow forming satisfy the relation (T1)-(T2)≥30° C. It is more preferable that the two temperatures (T1) and (T2) satisfy the relation (T1)-(T2)≥50° C.

At a time of (T1)-(T2)<30° C., a difference between the deformation resistance of the portion of the aluminum alloy sheet in contact with the protruding surface portion on the inside surface of the first metal mold and the deformation resistance of the portion of the aluminum alloy sheet not in contact with the inside surface of the first metal mold becomes small during the hot blow forming. In this case, cracking of the aluminum alloy sheet at the protruding surface portion on the inside surface of the first metal mold may not be inhibited sufficiently.

Out of various aluminum alloys, for example, regarding an Al—Mg—Si based aluminum alloy (JIS6000-series aluminum alloy, hereinafter referred to as 6000-series aluminum alloy), which is a heat treatment type alloy, precipitation becomes remarkable and blow formability becomes remarkably lower in a temperature range lower than 400° C. Therefore, it is necessary for the temperature (T2) to be equal to or more than 400° C. in order to secure sufficient blow formability of aluminum alloy.

When the temperature (T2) is lower than 400° C., the ductility of the portion of the aluminum alloy in contact with the protruding surface portion on the inside surface of the first metal mold becomes extremely lower at the time of hot blow forming, and cracking of the aluminum alloy sheet at the protruding surface portion of the inside surface of the first metal mold is not sufficiently suppressed.

When the temperature (T2) is lower than 400° C., the deformation resistance of the portion of the aluminum alloy in contact with the protruding surface portion of the inside surface of the first metal mold becomes higher. Especially when an Al—Mg based aluminum alloy having Mg content of 4 mass % or more (1155000-series aluminum alloy, hereinafter referred to as 5000-series aluminum alloy) is used, the aluminum alloy sheet is not able to be brought into contact with the protruding surface portion of the inside surface of the first metal mold within 30 seconds from a start of the gas introduction from the second metal mold at a gas pressure lower than 1 MPa that is not considered as a high pressure container in Japan.

According to the hot blow forming method for the aluminum alloy sheet, through the hot blow forming, the aluminum alloy sheet is made to be brought into contact with at least a part of the protruding surface portion of the first metal mold within 30 seconds from a start of the gas introduction from the second metal mold.

When the aluminum alloy sheet is not made to be brought into contact with the protruding surface portion of the inside surface of the first metal mold within 30 seconds from a start of the gas introduction using the second metal mold during the hot blow forming, the difference between the deformation resistance of the portion of the aluminum alloy sheet in contact with the protruding surface portion of the inside surface of the first metal mold and the deformation resistance of the portion of the aluminum alloy sheet not in contact with the inside surface of the first metal mold becomes small due to thermal diffusion from the aluminum alloy sheet to the first metal mold. In this case, cracking of the aluminum alloy sheet at the protruding surface portion of the inside surface of the first metal mold is not sufficiently inhibited.

During the hot blow forming, it is preferable that the temperature difference between the aluminum alloy sheet and the first metal mold is equal to or more than 30° C. until the compression of forming of a portion of the aluminum alloy sheet corresponding to the protruding surface portion of the inside surface of the first metal mold (until the contact of the aluminum alloy sheet with the entire protruding surface portion of the inside surface of the first metal mold.) That is, it is preferable to keep the temperature condition ((T1)-(T2)≥30° C.) immediately prior to the hot blow forming. In this case, it is possible to inhibit more stably cracking of the aluminum alloy sheet which may easily occur at the protruding surface portion of the inside surface of the first metal mold being the female mold for forming at the time of hot blow forming.

According to the hot blow forming method for the aluminum alloy sheet, the temperature (T3) of the second metal mold immediately before the hot blow forming may be lower than the melting point of the aluminum alloy sheet and equal to or higher than the temperature (T1). In this case, by controlling the temperature (T3) of the second metal mold immediately prior to hot blowing within a predetermined temperature range, it is possible to control the temperature (T1) of the aluminum alloy sheet immediately prior to hot blowing not to become low. Therefore, cracking of the aluminum alloy sheet, which easily occurs at the protruding surface portion of the inside surface of the first metal mold being the female mold for forming, is suppressed more stably at the time of hot blow forming.

In order not to melt the aluminum alloy sheet prior to hot blow forming, it is necessary, for example, to control the temperature (T3) of the second metal mold lower than the melting point of the aluminum alloy sheet while the aluminum alloy sheet is being held by the first and second metal molds.

The hot blow forming method for the aluminum alloy sheet is applicable to an aluminum alloy sheet having a melting point greater than 430° C. Aluminum alloys are selected depending upon usages, so aluminum alloys are not necessarily limited. However, when the hot blow forming is applied to a component for transporter such as automobile, to a component for a home electric appliance such as digital camera, personal computer, the formed product after the hot blow forming is required to have enough strength and appearance quality (surface quality). Therefore, such 5000-series aluminum alloy, 6000-series aluminum alloy and so on are considered to be appropriate aluminum alloy.

According to the hot blow forming method for the aluminum alloy sheet, the aluminum alloy sheet is an aluminum alloy sheet composed of, by mass %, 1.1 to 6.5% Mg, 0.01 to 0.3% Fe, and the balance Al and inevitable impurities, and the temperature (T1) may be equal to or lower than 550° C. In this case, usage of aluminum alloy sheet composed of the 5000-series aluminum alloy can secure enough strength and appearance quality (surface quality) for the formed product after being subjected to the hot blow forming.

In terms of strength, the 5000-series aluminum alloy composing the aluminum alloy sheet preferably contains 1.1 to 6.5% Mg. When the Mg content is lower than 1.1%, the strength required for components for transporters, home electric appliances, and so on, is not obtained, and shortage of strength is likely to occur. When the Mg content is more than 6.5%, cracking may occur by casting or hot rolling.

In terms of appearance quality, the 5000-series aluminum alloy composing the aluminum alloy sheet preferably contains 0.01 to 0.3% Fe so that crystal grain after the compression of hot blow forming becomes fine. When the Fe content is lower than 0.01%, coarsening of the crystal grain may occur during the hot blow forming and surface roughness called orange peel may easily occur, which may cause defects of outer appearance. When the Fe content is more than 0.3%, coarse crystalized products are easily generated by casting and cracking may occur at the time of hot rolling.

Coarsening of the crystal grain of the aluminum alloy sheet during the hot blow forming is influenced by the hot blow forming conditions as well as by chemical components of aluminum alloy (5000-series aluminum alloy). Especially, when the temperature of the aluminum alloy sheet during the hot blow forming is high, the crystal grain is likely to be coarsened. Therefore, it is preferable that the temperature (T1) of the aluminum alloy sheet immediately prior to the hot blow forming is equal to or lower than 550° C., further preferably equal to or lower than 530° C. When the temperature (T1) is more than 550° C., the crystal grain is likely to be coarsened during the hot blow forming and generation of orange peels on the surface of the formed product is likely to occur. This may result in poor appearance of the formed product.

According to the hot blow forming method for the aluminum alloy sheet, the aluminum alloy sheet is an aluminum alloy sheet composed of, by mass %, 0.2 to 2.0% Si, 0.2 to 1.5% Mg, 0.01 to 0.3% Fe, and the balance Al and inevitable impurities, and the temperature (T1) may be equal to or lower than 550° C. In this case, usage of an aluminum alloy sheet composed of the 6000-series aluminum alloy can secure enough strength and appearance quality (surface quality) for the formed product after being subjected to the hot blow forming.

In terms of strength, the 6000-series aluminum alloy composing the aluminum alloy sheet preferably contains 0.2 to 2.0% Si and 0.2 to 1.5% Mg. When the Si content is lower than 0.2% and/or when the Mg content is lower than 0.2%, it is likely that the strength required for components for transporters, home electric appliances, and so on, is not obtained, and that shortage of strength occur. When the Si content is more than 2.0% and/or when the Mg content is more than 1.5%, coarse crystalized products are likely to be created upon casting, which may lead to occurrence of cracking upon hot rolling.

In terms of appearance quality, the 6000-series aluminum alloy composing the aluminum alloy sheet preferably contains 0.01 to 0.3% Fe so that crystal grain after the compression of hot blow forming becomes fine. When the Fe content is lower than 0.01%, coarsening of the crystal grain may occur during the hot blow forming and surface roughness called orange peel may easily occur, which lead to defects of outer appearance. When the Fe content is more than 0.3%, coarse crystalized products are easily generated by casting and cracking may occur at the time of hot rolling.

Coarsening of the crystal grain of the aluminum alloy sheet during the hot blow forming is influenced by the hot blow forming conditions as well as by chemical components of aluminum alloy (6000-series aluminum alloy). Especially, when the temperature of the aluminum alloy sheet during the hot blow forming is high, the crystal grain is likely to be coarsened. Therefore, it is preferable that the temperature (T1) of the aluminum alloy sheet immediately prior to the hot blow forming is equal to or lower than 550° C., further preferably equal to or lower than 530° C. When the temperature (T1) is more than 550° C., crystal grain is likely to be coarsened during the hot blow forming and generation of orange peels on the surface of the formed product is likely to occur. This may result in poor appearance of the formed product.

EMBODIMENTS

Embodiments of the present invention will be described below compared with comparative examples. These embodiments illustratively describe the present invention and the present invention shall not be limited hereto.

<Aluminum Alloy Sheet (Blank Member)>

Aluminum alloys having chemical compositions summarized in Table 1 were ingot-made by Direct Chill (DC) casting and cooled to a room temperature after being subjected to homogenization treatment under the conditions summarized in Table 1. "Bal." in Table 1 denotes the balance (Balance). The melting points of the aluminum alloys 5023, 5083, and 6016 are 562° C., 574° C., and 588° C., respectively.

The obtained aluminum alloy ingots were then heated again to 400° C., and then the ingots were subjected to hot rolling, so that hot rolled sheets with the thickness 5.0 mm were obtained. The hot rolling end temperature was 250° C. Further, the obtained hot rolled sheets were subjected to cool rolling to have 1.0 mm in thickness and to annealing at 400° C. for an hour, so that aluminum alloy sheets (blank members) for hot blow forming were obtained.

TABLE 1

| | Contained Components (mass %) | | | | | | | | | Homogenization Treatment |
|---|---|---|---|---|---|---|---|---|---|---|
| Alloy | Si | Fe | Cu | Mn | Mg | Cr | Zn | Ti | Al | (Temp. - Time) |
| 5023 | 0.03 | 0.04 | 0.2 | 0.01 | 5.2 | <0.01 | <0.01 | 0.03 | Bal. | 450° C. - 12 h |
| 5083 | 0.03 | 0.05 | <0.01 | 0.67 | 4.6 | 0.15 | <0.01 | 0.02 | Bal. | 500° C. - 12 h |
| 6016 | 1.10 | 0.13 | <0.01 | 0.10 | 0.6 | <0.01 | 0.0 | 0.03 | Bal. | 550° C. - 12 h |

Embodiment 1

<Metal Mold for Forming>

Figure 2:
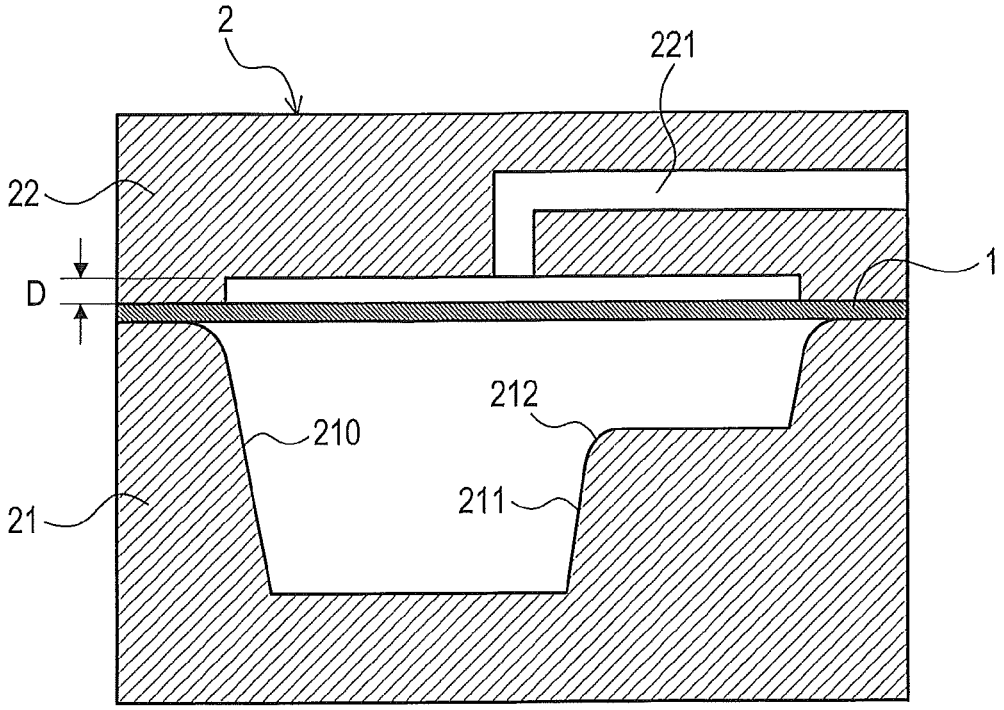
FIG. 2 is a cross-sectional view illustrating an aluminum alloy sheet and a mold for Experiment 1.

As illustrated in FIGS. 1 and 2, a metal mold for forming 2 has a recessed first metal mold 21 being a female mold for forming and a second metal mold 22 for gas introduction. The metal mold for forming 2 is configured so that an aluminum alloy sheet 1 is held by the first metal mold 21 and the second metal mold 22. The second metal mold 22 has a gas introduction conduit 221 to introduce high pressure gas for blow forming.

Figure 3:
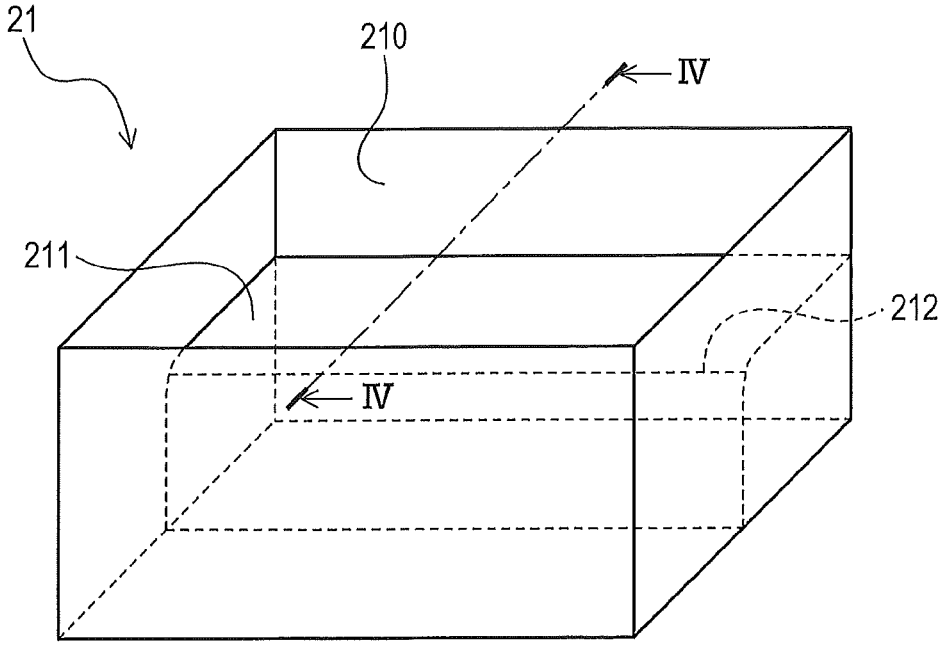
FIG. 3 is a schematic view illustrating a first mold for Experiment 1.
Figure 4:
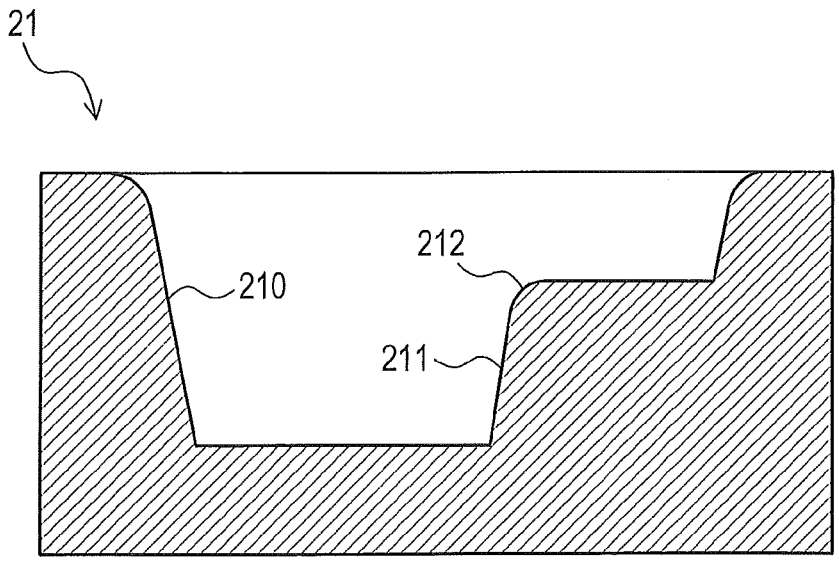
FIG. 4 is a cross-sectional view with respect to arrows IV to IV in FIG. 3.

As illustrated in FIGS. 3 and 4, provided on an inside surface (forming surface) 210 of the first metal mold 21 is a protruding surface portion 211 protruding towards the inside of the first metal mold 21. The protruding surface portion 211 has 60 mm in height from the bottom surface of the first metal mold 21. A top 212 of the protruding surface portion 211 is formed into a curved surface having a curvature radius of 5 mm.

<Blow Formability>

Figure 5:
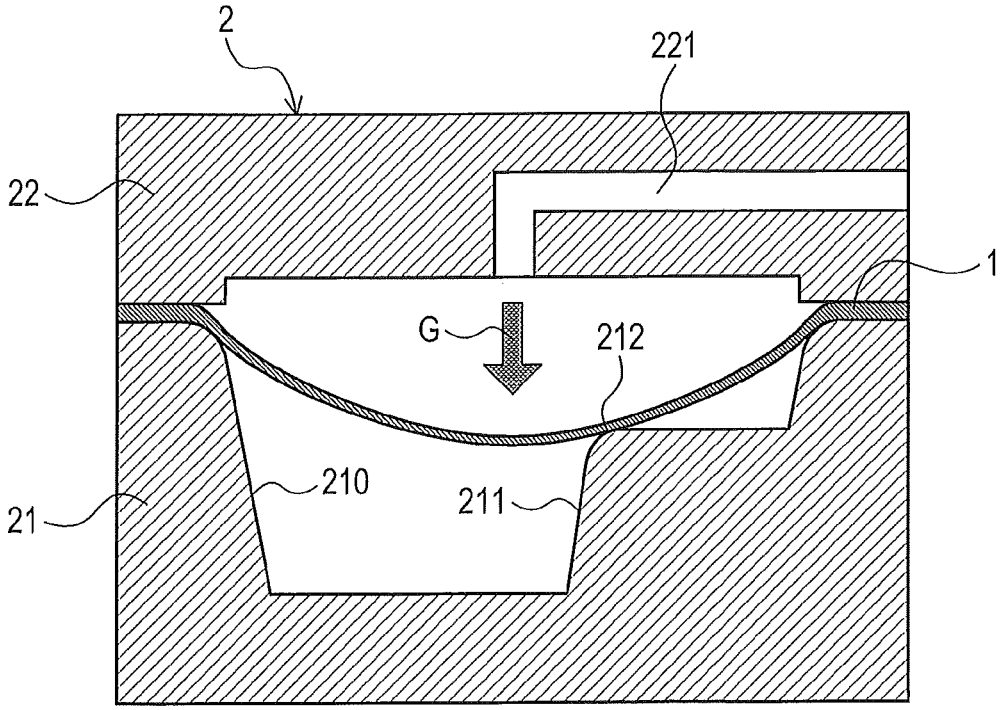
FIG. 5 is a cross-sectional view illustrating the aluminum alloy sheet in contact with a forming surface of the first mold in Experiment 1.
Figure 6:
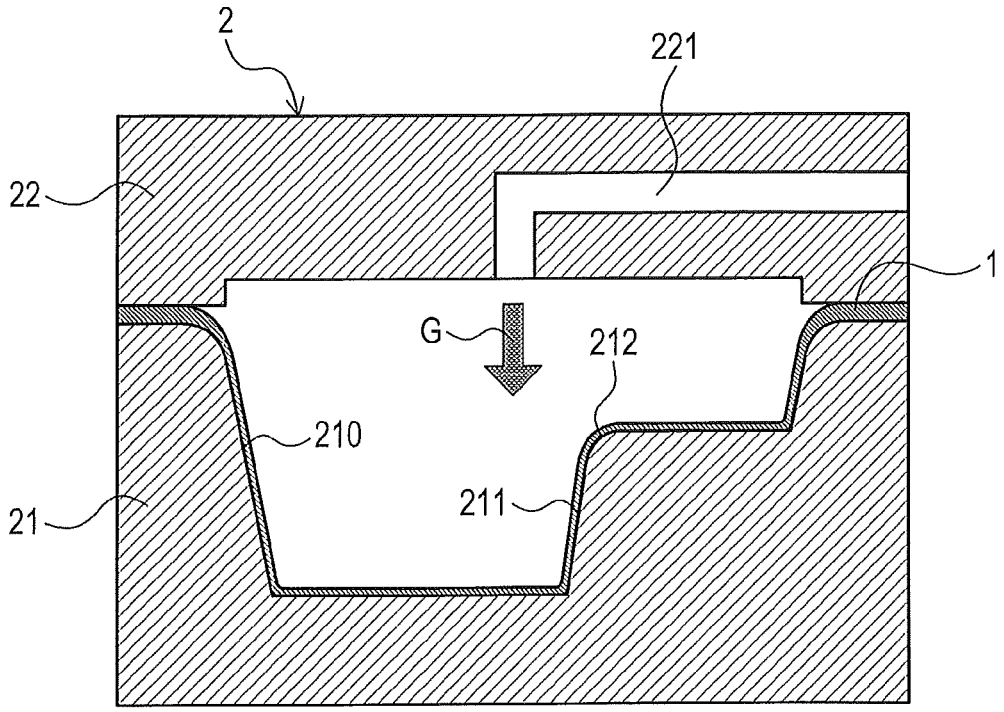
FIG. 6 is a cross-sectional view illustrating the aluminum alloy sheet formed by the forming surface of the first mold in Experiment 1.

As illustrated in FIGS. 5 and 6, hot blow formings having various conditions were carried out to the aluminum alloy sheet 1 by use of the aforementioned metal mold for forming 2. Table 2 summarizes various conditions including the temperature (T1) of the aluminum alloy sheet immediately prior to the hot blow forming, the temperature (T2) of the first metal mold immediately prior to the hot blow forming, the temperature (T3) of the second metal mold immediately prior to the hot blow forming, and the gas pressure. When the gas pressure is 0.98 to 0.99 MPa, the gas pressure is rounded and described as 1 MPa.

As illustrated in FIG. 5, for the hot blow forming, in a state where the aluminum alloy sheet 1 has been held by the first metal mold 21 and the second metal mold 22 of the metal mold for forming 2, a high pressure gas G was introduced into the metal mold for forming 2 from the gas introduction conduit 221 of the second metal mold 22 and was sprayed to the aluminum alloy sheet 1 from the side of the second metal mold 22. As illustrated in FIG. 6, the aluminum alloy sheet 1 was pressed to the inside surface (forming surface) 210 of the first metal mold 21 so as to be formed to a predetermined shape. A distance D between the gas introduction surface of the second metal mold 22 and the aluminum alloy sheet 1 was 50 mm, and nitrogen gas was employed as the gas G.

The pass/fail assessment of the blow formability was made for the occurrence of cracking of aluminum alloy sheet at the protruding surface portion (especially, the top) of the inside surface (forming surface) of the first metal mold during the hot blow forming. The aluminum alloy sheet with no cracking passed (○: no cracking) and the one with cracking failed (x: with cracking).

TABLE 2

| | Sample | Alloy | Aluminum Alloy Sheet Temp. (T1) (° C.) | First Metal Mold Temp. (T2) (° C.) | Second Metal Mold Temp. (T3) (° C.) | Gas Pressure (MPa) | Forming Time (second) | Blow Formability |
|---|---|---|---|---|---|---|---|---|
| EMBODIMENT | 1 | 5023 | 430 | 400 | 430 | 1 | 30 | ○ |
| | 2 | 5023 | 500 | 450 | 520 | 1 | 15 | ○ |
| | 3 | 5083 | 430 | 400 | 430 | 1 | 30 | ○ |
| | 4 | 5083 | 540 | 400 | 550 | 1 | 20 | ○ |
| | 5 | 6016 | 430 | 400 | 430 | 1 | 30 | ○ |
| | 6 | 6016 | 550 | 500 | 550 | 0.5 | 10 | ○ |
| COMPARATIVE | 7 | 5023 | 425 | 400 | 425 | 1 | 30 | x |
| | 8 | 5023 | 500 | 475 | 500 | 1 | 30 | x |
| | 9 | 5023 | 430 | 400 | 430 | 0.5 | 60 | x |
| | 10 | 5083 | 425 | 400 | 425 | 1 | 30 | x |
| | 11 | 5083 | 520 | 500 | 520 | 1 | 25 | x |
| | 12 | 5083 | 430 | 400 | 430 | 0.5 | 60 | x |
| | 13 | 5083 | 390 | 360 | 390 | 1 | 70 | x |

TABLE 2-continued

| Sample | Alloy | Aluminum Alloy Sheet Temp. (T1) (° C.) | First Metal Mold Temp. (T2) (° C.) | Second Metal Mold Temp. (T3) (° C.) | Gas Pressure (MPa) | Forming Time (second) | Blow Formability |
|---|---|---|---|---|---|---|---|
| 14 | 6016 | 425 | 400 | 425 | 1 | 30 | x |
| 15 | 6016 | 540 | 525 | 540 | 0.5 | 10 | x |
| 16 | 6016 | 430 | 400 | 430 | 0.2 | 50 | x |
| 17 | 6016 | 400 | 370 | 400 | 1 | 30 | x |

Table 2 summarizes the results of blow formabilities for the respective samples. The forming time in Table 2 is a period of time from the start of gas introduction to the moment when the aluminum alloy sheet contacts the protruding surface portion of the first metal mold (a period of time from the start of gas introduction to the moment when the aluminum alloy sheet is shifted to the state illustrated in FIG. 5).

Samples 1 to 6 satisfy the relation (T1)-(T2)≥30° C., the temperatures (T2) thereof are equal to or more than 400° C., and the forming times thereof are within 30 seconds. For Samples 1 to 6, no cracking occurred at the protruding surface portion of the first metal mold, and preferable blow formabilities were obtained.

Samples 7, 8, 10, 11, 14, and 15 do not satisfy the relation (T1)-(T2)≥30° C. The temperature (T2) of Sample 17 is lower than 400° C. For Samples 7, 8, 10, 11, 14, 15, and 17, cracking occurred at the protruding surface portion of the first metal mold.

Samples 9, 12, 13, and 16 did not contact the protruding surface portion of the first metal mold within 30 seconds of the forming time and contacted the protruding surface portion of the first metal mold in the forming time over 30 seconds of the forming time. The temperature (T2) of Sample 13 is lower than 400° C. For samples 9, 12, 13, and 16, cracking occurred at the protruding surface portion of the first metal mold.

Embodiment 2

<Metal Mold for Forming>

Figure 7:
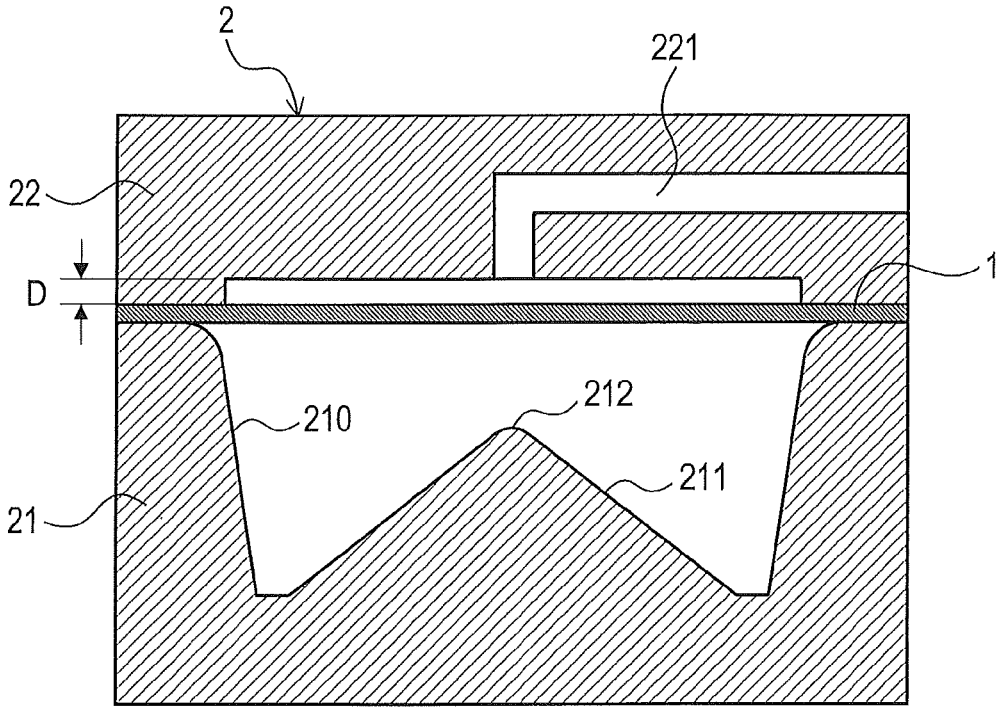
FIG. 7 is a cross-sectional view illustrating an aluminum alloy sheet and a mold for Experiment 2.

As illustrated in FIG. 7, a metal mold for forming 2 has a recessed first metal mold 21 being a female mold for forming and a second metal mold 22 for gas introduction. The metal mold for forming 2 is configured so that the aluminum alloy sheet 1 is held by the first metal mold 21 and the second metal mold 22. The second metal mold 22 has a gas introduction conduit 221 to introduce high pressure gas for blow forming.

Figure 8:
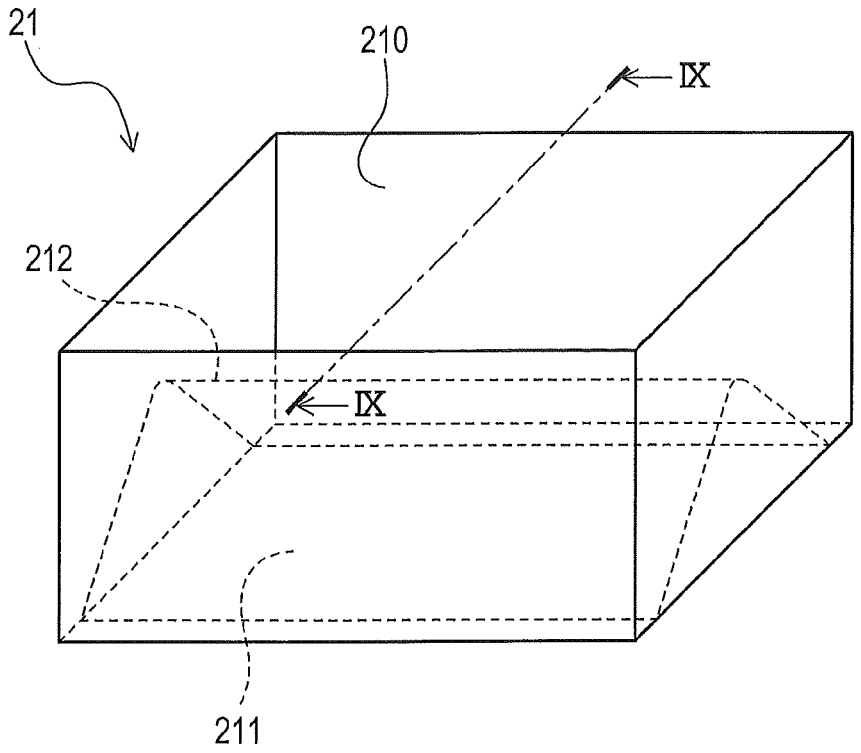
FIG. 8 is a schematic view illustrating a first mold for Experiment 2.
Figure 9:
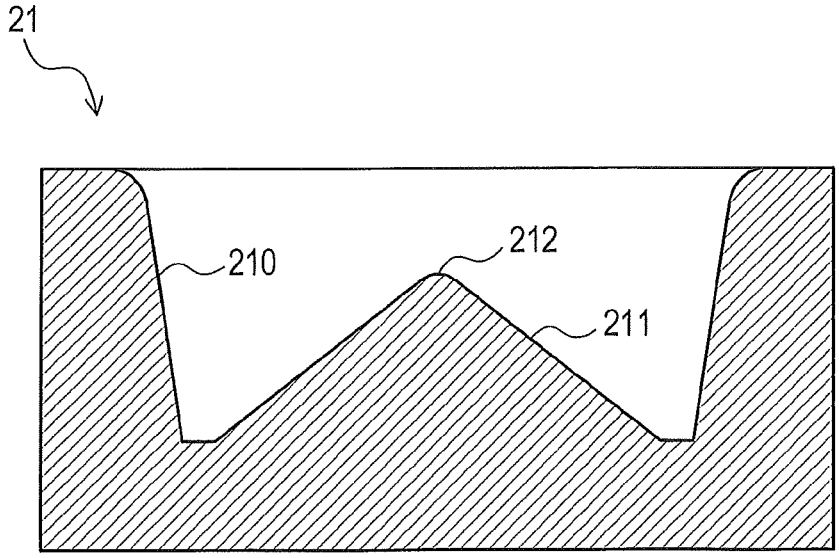
FIG. 9 is a cross-sectional view with respect to arrows IX to IX in FIG. 8.

As illustrated in FIGS. 8 and 9, provided on an inside surface (forming surface) 210 of the first metal mold 21 is a protruding surface portion 211 protruding towards the inside of the first metal mold 21. The protruding surface portion 211 has 70 mm in height from the bottom surface of the first old 21. A top 212 of the protruding surface portion 211 is formed into a curved surface having a curvature radius of 6 mm.

<Blow Formability>

Figure 10:
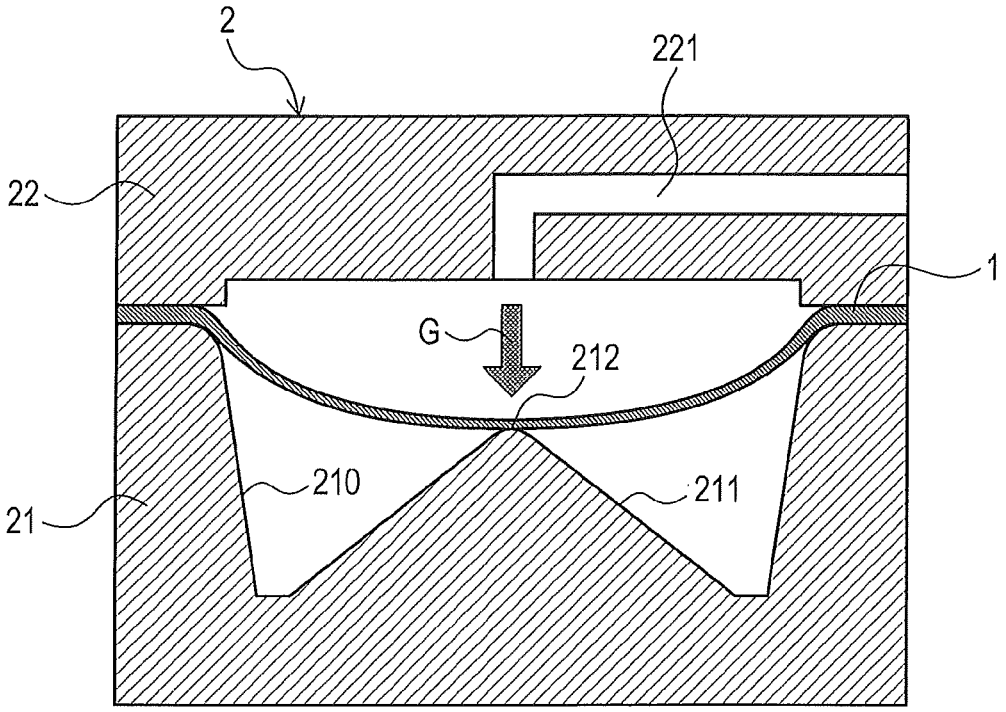
FIG. 10 is a sectional view illustrating the aluminum alloy sheet in contact with a forming surface of the first mold in Experiment 2.
Figure 11:
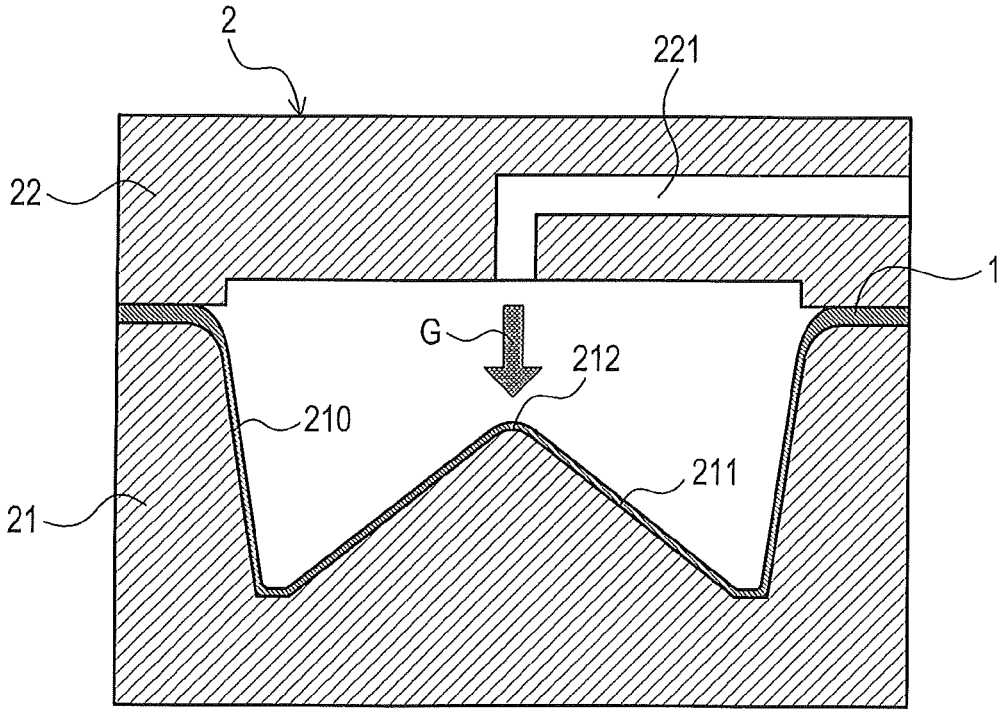
FIG. 11 is a cross-sectional view illustrating the aluminum alloy sheet formed by the forming surface of the first mold in Experiment 2.

As illustrated in FIGS. 10 and 11, hot blow formings having various conditions were carried out to an aluminum alloy sheet 1 by use of the aforementioned metal mold for forming 2. Table 3 summarizes various conditions including the temperature (T1) of the aluminum alloy sheet immediately prior to the hot blow forming, the temperature (T2) of the first metal mold immediately prior to the hot blow forming, the temperature (T3) of the second metal mold immediately prior to the hot blow forming, and the gas pressure. When the gas pressure is 0.98 to 0.99 MPa, the gas pressure was rounded and described as 1 MPa.

As illustrated in FIG. 10, for the hot blow forming, in a state where the aluminum alloy sheet 1 has been held by the first metal mold 21 and the second metal mold 22 of the metal mold for forming 2, a high pressure gas G was introduced into the metal mold for forming 2 from the gas introduction conduit 221 of the second metal mold 22 and was sprayed to the aluminum alloy sheet 1 from the side of the second metal mold 22. As illustrated in FIG. 11, the aluminum alloy sheet 1 was pressed to the inside surface (forming surface) 210 of the first metal mold 21 so as to be formed to a predetermined shape. A distance D between the gas introduction surface of the second metal mold 22 and the aluminum alloy sheet 1 was 50 mm, and nitrogen gas was employed as the gas G.

The pass/fail assessment of the blow formability is made for the occurrence of cracking of aluminum alloy sheet at the protruding surface portion (especially top) of the inside surface (forming surface) of the first metal mold during the hot blow forming. The aluminum alloy sheet with no cracking passed (○: no cracking) and the one with cracking failed (x: with cracking).

<Orange Peel Occurrence>

For the surfaces of the formed products after being subjected to the hot blow forming, the surface roughness was measured by a contact-type surface roughness meter. The formed product passed (○: no occurrence) when it was Rz≤20 μm (Rz: Maximum Height Roughness) and failed (x: with occurrence) when it was Rz>20 μm (Rz: Maximum Height Roughness).

TABLE 3

| | Sample | Alloy | Aluminum Alloy Sheet Temp. (T1) (° C.) | First Metal Mold Temp. (T2) (° C.) | Second Metal Mold Temp. (T3) (° C.) | Gas Pressure (MPa) | Forming Time (second) | Blow Formability | Orange Peel Occurrence |
|---|---|---|---|---|---|---|---|---|---|
| EMBODIMENT | 18 | 5023 | 430 | 400 | 430 | 1 | 30 | ○ | ○ |
| | 19 | 5023 | 520 | 420 | 530 | 1 | 20 | ○ | ○ |
| | 20 | 5083 | 430 | 400 | 430 | 1 | 30 | ○ | ○ |
| | 21 | 5083 | 530 | 400 | 545 | 1 | 20 | ○ | ○ |
| | 22 | 6016 | 430 | 400 | 430 | 1 | 30 | ○ | ○ |
| | 23 | 6016 | 540 | 480 | 545 | 0.5 | 10 | ○ | ○ |
| COMPARATIVE | 24 | 5023 | 425 | 400 | 425 | 1 | 30 | x | ○ |
| | 25 | 5023 | 520 | 500 | 520 | 1 | 30 | x | ○ |
| | 26 | 5023 | 430 | 400 | 430 | 0.6 | 50 | x | ○ |
| | 27 | 5083 | 425 | 400 | 425 | 1 | 30 | x | ○ |
| | 28 | 5083 | 555 | 530 | 560 | 1 | 20 | x | x |
| | 29 | 5083 | 430 | 400 | 430 | 0.6 | 50 | x | ○ |
| | 30 | 5083 | 390 | 360 | 390 | 1 | 60 | x | ○ |
| | 31 | 6016 | 425 | 400 | 425 | 1 | 30 | x | ○ |
| | 32 | 6016 | 560 | 545 | 560 | 0.7 | 5 | x | x |
| | 33 | 6016 | 430 | 400 | 430 | 0.3 | 40 | x | ○ |
| | 34 | 6016 | 410 | 380 | 410 | 1 | 30 | x | ○ |

Table 3 summarizes the results of blow formabilities and orange peel occurrences for the respective samples. The forming time in Table 3 is a period of time from the start of gas introduction to the moment when the aluminum alloy sheet contacts the protruding surface portion of the first metal mold (a period of time from the start of gas introduction to the moment when the aluminum alloy sheet is shifted to the state illustrated in FIG. 10).

Samples 18 to 23 satisfied the relation (T1)-(T2)≥30° C., the temperatures (T2) thereof were equal to or more than 400° C., and the forming times in which the aluminum alloy sheets contacted the protruding surface portion of the inside surface of the first metal mold were within 30 seconds. For Samples 18 to 23, no cracking occurred at the protruding surface portion of the first metal mold, and preferable blow formabilities were obtained. In addition, no orange peel occurred on the surfaces of the formed products after being subjected to forming.

Samples 24, 25, 27, 28, 31, and 32 do not satisfy the relation (T1)-(T2)≥30° C. The temperature (T2) of Sample 34 is lower than 400° C. For Samples 24, 25, 27, 28, 31, 32, and 34, cracking occurred at the protruding surface portion of the first metal mold.

Samples 26, 29, 30, and 33 did not contact the protruding surface portion of the first metal mold within 30 seconds of the forming time and contacted the protruding surface portion of the first metal mold in the forming time over 30 seconds of the forming time. The temperature (T2) of Sample 30 is lower than 400° C. For Samples 26, 29, 30, and 33, cracking occurred at the protruding surface portion of the first metal mold.

The temperatures (T1) of Samples 28 and 32 are higher than 550° C. For Samples 28 and 32, orange peels occurred on the surfaces of the formed products after being subjected to the forming.

The invention claimed is:

1. A hot blow forming method for an aluminum alloy sheet comprising:

carrying out hot blow forming for the aluminum alloy sheet using a first metal mold, which is a female mold for forming having a protruding surface portion on an inside surface thereof, and a second metal mold for gas introduction, wherein, immediately prior to the hot blow forming, a temperature (T1) of the aluminum alloy sheet and a temperature (T2) of the first metal mold satisfy a relation (T1)-(T2)≥30° C., and the temperature (T2) is equal to or more than 400° C., and wherein, in the hot blow forming, the aluminum alloy sheet is brought into contact with at least a part of the protruding surface portion of the first metal mold within 30 seconds from a start of gas introduction from the second metal mold.

2. The hot blow forming method for an aluminum alloy sheet according to claim 1, wherein a temperature (T3) of the second metal mold immediately prior to the hot blow forming is lower than a melting point of the aluminum alloy sheet and is equal to or higher than the temperature (T1).

3. The hot blow forming method for an aluminum alloy sheet according to claim 1, wherein the aluminum alloy sheet is comprised of, by mass %, 1.1 to 6.5% Mg, 0.01 to 0.3% Fe, and a balance Al and inevitable impurities, and wherein the temperature (T1) is equal to or lower than 550° C.

4. The hot blow forming method for an aluminum alloy sheet according to claim 1, wherein the aluminum alloy sheet is comprised of, by mass %, 0.2 to 2.0% Si, 0.2 to 1.5% Mg, 0.01 to 0.3% Fe, and a balance Al and inevitable impurities, and wherein the temperature (T1) is equal to or lower than 550° C.

* * * * *